US006694941B2

(12) United States Patent
Ueda et al.

(10) Patent No.: US 6,694,941 B2
(45) Date of Patent: Feb. 24, 2004

(54) STARTER

(75) Inventors: Tamotsu Ueda, Kanagawa (JP); Toshio Taomo, Tokyo (JP); Yutaka Yamada, Iwate (JP); Shingo Kishida, Kanagawa (JP); Junichi Akaike, Tokyo (JP); Kazumasa Iida, Toyama (JP)

(73) Assignee: Kioritz Corporation, Tokyo (JP)

( * ) Notice: Subject to any disclaimer, the term of this patent is extended or adjusted under 35 U.S.C. 154(b) by 27 days.

(21) Appl. No.: 10/022,646

(22) Filed: Dec. 17, 2001

(65) Prior Publication Data

US 2003/0037750 A1 Feb. 27, 2003

(30) Foreign Application Priority Data

Aug. 24, 2001 (JP) ..... 2001-254025

(51) Int. Cl.[7] ..... F02N 3/02; F02N 5/02

(52) U.S. Cl. ..... 123/185.14; 123/185.3; 185/41 A

(58) Field of Search ..... 123/185.2, 185.3, 123/185.14, 185.4; 185/39, 40 R, 41 R, 41 A

(56) References Cited

U.S. PATENT DOCUMENTS 4,480,605 A * 11/1984 Bloemers ..... 123/185.3
5,287,832 A * 2/1994 Uhl ..... 123/185.3
6,508,220 B1 * 1/2003 Akaike et al. ..... 123/185.14

* cited by examiner

*Primary Examiner*—Hieu T. Vo
*Assistant Examiner*—Arnold Castro
(74) *Attorney, Agent, or Firm*—Baker Botts LLP

(57) ABSTRACT

There is provided a recoil starter which is capable of inhibiting settling and bending in the spiral spring of spiral spring mechanism, thus improving the durability of the spiral spring and preventing the internal hook end of the spiral spring from being easily disengaged from the core portion. The spiral spring mechanism comprises a spiral spring case placed close to the driving member, a actuating pulley placed close to the driven member, a spiral spring interposed between the spiral spring case and the actuating pulley, and means for rotating the spiral spring case only unidirectionally, wherein the outer and inner ends of the spiral spring are fastened to the spiral spring case and the actuating pulley, respectively.

14 Claims, 7 Drawing Sheets

STARTER

BACKGROUND OF THE INVENTION

The present invention relates to a recoil starter which is adapted for use in an internal combustion engine, and in particular, to a recoil starter provided with a buffering/power-accumulating means which is interposed between a driving member comprising a rope reel which is designed to be rotated by the pulling of a recoil rope, and a driven member to which the torque of the driving member is transmitted.

A conventional recoil starter which is designed to be mounted on an internal combustion engine is generally provided with a driving member comprising a rope reel around which a recoil rope is wound, and a driven (idler) member comprising a centrifugal ratchet mechanism. When the internal combustion engine is desired to be started, the recoil rope (recoil handle) is pulled to revolve the rope reel, the resultant revolution of the rope reel being then transmitted, via the driven member, to a crankshaft of the internal combustion engine to thereby start the internal combustion engine.

As set forth in Japanese Patent Application No. H11-238642, the present inventors have previously proposed a modification of the aforementioned recoil starter, wherein a spiral spring mechanism is interposed, as the buffering/power-accumulating means, between the driving member and the driven member.

According to this modified recoil starter, since the spiral spring mechanism is interposed, as the buffering/power-accumulating means, between the driving member and the driven member, it is possible to derive a buffering effect from the spiral spring mechanism during the first-half driving process (until the piston of the internal combustion engine reaches to the top dead center thereof) in the pulling operation of the recoil rope (recoiling operation), and at the same time, to enable the pulling force of the recoil rope to be accumulated in the spiral spring mechanism. During the latter-half driving process, the pulling force thus accumulated in the spiral spring mechanism during the first-half driving process is permitted to be combined with the pulling force to be actually effected in the latter-half pulling operation of the recoil rope to thereby generate a resultant force, which is utilized as a force for starting the internal combustion engine.

As a result, it is possible to minimize a fluctuation in pulling force of rope so as to smooth the rope-pulling operation, thus enabling even a person having a weak physical strength to easily start the internal combustion engine.

However, this modified recoil starter previously proposed by the present inventors is accompanied with the following possible problems.

Namely, since this modified recoil starter is designed such that the spiral spring of the spiral spring mechanism is rewound so as to accumulate the pulling force during the first-half driving process in the pulling operation of the recoil rope (recoiling operation), that during the latter-half driving process, the pulling force thus accumulated during the first-half driving process is released, thus unwinding the spiral spring and enabling the spiral spring to be restored to the original released state thereof, while permitting the spiral spring mechanism to rotate in the direction to drive the crankshaft, and that after the start-up of the internal combustion engine, the interlocking engagement between the spiral spring mechanism and the internal combustion engine is permitted to be released due to the releasing action by the centrifugal ratchet mechanism attached to the driven member, thus rendering the spiral spring mechanism to become free, the spiral spring is permitted, due to the inertia of the releasing movement of the spiral spring, to be excessively kicked back in the unwinding direction (releasing direction) even after the spiral spring has taken the fully unwound and released state thereof.

Generally, a spiral spring is usually employed, as in the case of a watch, under the conditions where the spiral spring is completely wound up and is then incompletely unwound leaving one or two unreleased turns. In the case of the aforementioned recoil starter however, since the spiral spring mechanism is rendered free after the start-up of the internal combustion engine, the spiral spring is completely released without leaving even a single unreleased turn, and is still more permitted to be excessively kicked back in the unwinding direction. Namely, the spiral spring is not used in a manner which the spiral spring is inherently intended to.

Therefore, the innermost end region of the spiral spring is repeatedly and locally subjected to a winding/unwinding stress, thus giving rise to the generation of settling and bending at this innermost end region of the spiral spring. As a result, not only the durability of the spiral spring is badly affected, but also the internal hook end of the spiral spring which is fastened to the core portion of the actuating pulley of spiral spring mechanism tends to be disengaged from the core portion, thereby raising a possibility that the rope-pulling manipulation may result in a futile try.

The present invention has been made in view of the aforementioned problems, and therefore, it is an object of the present invention to provide a recoil starter having a spiral spring mechanism interposed, as a buffering/power-accumulating means, between a driving member comprising a rope reel which is designed to be rotated by the pulling of a recoil rope, and a driven member to which the torque of the driving member is transmitted, the recoil starter being characterized in that it is capable of inhibiting the generation of settling and bending in the spiral spring of the spiral spring mechanism, thereby making it possible not only to improve the durability of the spiral spring, but also to prevent the internal hook end of the spiral spring from being easily disengaged from the core portion of the actuating pulley of spiral spring mechanism. Another object of the present invention is to provide a spiral spring which is excellent in durability and therefore is suited for use in the recoil starter, etc.

BRIEF SUMMARY OF THE INVENTION

With a view to attaining the aforementioned object, there is provided, in accordance with the present invention, a recoil starter which fundamentally comprises a driving member having a rope reel around which a recoil rope is wound to thereby enable the rope reel to be rotated by pulling the recoil rope, a driven (idler) member to which the torque of the driving member is transmitted, and a buffering/power-accumulating means interdisposed between the driving member and the driven member; wherein the buffering/power-accumulating means is enabled, during the driving process by the driving member, to accumulate the power supplied through the driving process while alleviating any impact to the driven member, the accumulated power being subsequently employed to drive the driven member, and wherein the spiral spring mechanism is rendered free after the start-up of an internal combustion engine.

In this case, the spiral spring mechanism is featured in that it comprises a spiral spring case placed close to the driving member, a actuating pulley placed close to the driven member, a spiral spring interposed between the spiral spring case and the actuating pulley, and means for rotating the spiral spring case only unidirectionally, wherein an outer end portion of the spiral spring and an inner end portion of the spiral spring are fastened to the spiral spring case and the actuating pulley, respectively.

In a preferable embodiment of the present invention, the spiral spring of the spiral spring mechanism comprises an outer circumferential wound portion where a predetermined number of turns of the outer circumferentially wound portion of the spiral spring are closely contacted with each other under a freely released condition of the spiral spring, and an inner circumferential wound portion which is constituted by at least one turn of the inner circumferentially wound portion of the spiral spring, wherein a clearance is provided between the outer circumferential wound portion and the inner circumferential wound portion. More preferably, the outer circumferential wound portion is constituted by a third turn and the following turns successive to the third turn, and the inner circumferential wound portion is constituted by a first turn and at least a portion of the second turn which is closely contacted with the first turn.

In another preferred embodiment of the present invention, the recoil starter is featured in that the actuating pulley is provided with a core portion around which the spiral spring is wound, that the spiral spring is provided, at an inner end portion thereof, with a C-shaped or ring-shaped internal hook end, that said core portion is provided with an inner end-holding portion into which the internal hook end is adapted to be inserted and held therein, that the spiral spring is provided, at an outer end portion thereof, with an external hook end, and that the spiral spring case is provided, at an outer circumferential wall thereof, with an outer end-holding portion with which the external hook end is adapted to be engaged.

Preferably, the inner end portion of the spiral spring is positioned, under a freely released condition of the spiral spring, at a position which is displaced from the location of the outer end portion of the spiral spring by a predetermined angle toward the direction which is opposite to the driving direction. Further, the rotational axial line of the spiral spring mechanism is preferably displaced from the proper center of the spiral spring by a predetermined distance toward the outer end portion of the spiral spring.

In a further preferable embodiment of the present invention, the outer diameter of the core portion of actuating pulley is made almost identical with the effective inner diameter of the first turn of the spiral spring. At the same time, the effective outer diameter of the spiral spring under the freely released condition thereof is made almost identical with the effective inner diameter of the spiral spring case. Further, the effective inner diameter of the first turn of the spiral spring and the effective outer diameter of the core portion are set to 25 mm or more (preferably, 30 mm or so).

In another preferred embodiment of the recoil starter of the present invention, the driving member is provided with a recoiling urging means for reversely revolving the rope reel so as to rewind the recoil rope, and also with a recoil ratchet mechanism for transmitting the torque of the rope reel to the spiral spring case.

The means for rotating the spiral spring case only unidirectionally is preferably constituted by a one-way clutch. Further, the driven member is preferably provided with an interlocking pulley having a power transmission mechanism through which the driven member is enabled to interlockingly coupled with the driving member. In this case, the power transmission mechanism may preferably be constituted by a centrifugal ratchet mechanism.

Meanwhile, the spiral spring according to the present invention comprises an outer circumferential wound portion where a predetermined number of turns of the outer circumferentially wound portion of the spiral spring are closely contacted with each other under a freely released condition of the spiral spring, and an inner circumferential wound portion which is constituted by at least one turn of the inner circumferentially wound portion of the spiral spring, wherein a clearance is provided between the outer circumferential wound portion and the inner circumferential wound portion.

More preferably, the outer circumferential wound portion is constituted by a third turn and the following turns successive to the third turn, and the inner circumferential wound portion is constituted by a first turn and at least a portion of the second turn which is closely contacted with the first turn. More preferably, the inner end portion of the spiral spring is positioned, under a freely released condition of the spiral spring, at a position which is displaced from the location of the outer end portion of the spiral spring by a predetermined angle toward the direction which is opposite to the driving direction.

More preferably, the effective inner diameter of the first turn of the spiral spring is set to 25 mm or more. The spiral spring according to the present invention may preferably be formed of a stainless steel sheet having a thickness of 0.5 to 0.7 mm. It is also preferable that an annealing treatment is performed on the inner circumferential wound portion of the spiral spring.

In the embodiment of the recoil starter where the spiral spring of the present invention which is constructed as mentioned above is employed, since at least a portion of the second turn is closely contacted with the first turn at the inner circumferentially wound portion of the spiral spring, even if the interlocking between the spiral spring mechanism and the engine is disengaged from each other after the start-up of the engine due to the free releasing effects to be obtained from the centrifugal ratchet mechanism mounted on the driven member, thereby rendering the spiral spring mechanism into a free state, and hence permitting the spiral spring to be excessively kicked back in the unwinding direction (releasing direction) thereof beyond the predetermined full unwound state of the spiral spring due to the inertia on this occasion, this kick-back stress to be repeated by the effects of rewinding-releasing (unwinding) on this occasion can be received by the entire body of the inner circumferentially wound portion, thereby making it possible to suppress the generation of a concentration of the stress in the vicinity of the internal hook end of the spiral spring.

As a result, the generation of settling or breakage of the spiral spring can be prohibited, thereby making it possible to improve the durability of the spiral spring, and at the same time, the internal hook end of the spiral spring can be prevented from being easily disengaged from the core portion provided at the actuating pulley of the spiral spring mechanism, thereby further improving the reliability of the starter.

DETAILED DESCRIPTION OF THE INVENTION

Next, one embodiment of the starter according to the present invention will be explained with reference to the drawings.

Figure 1:
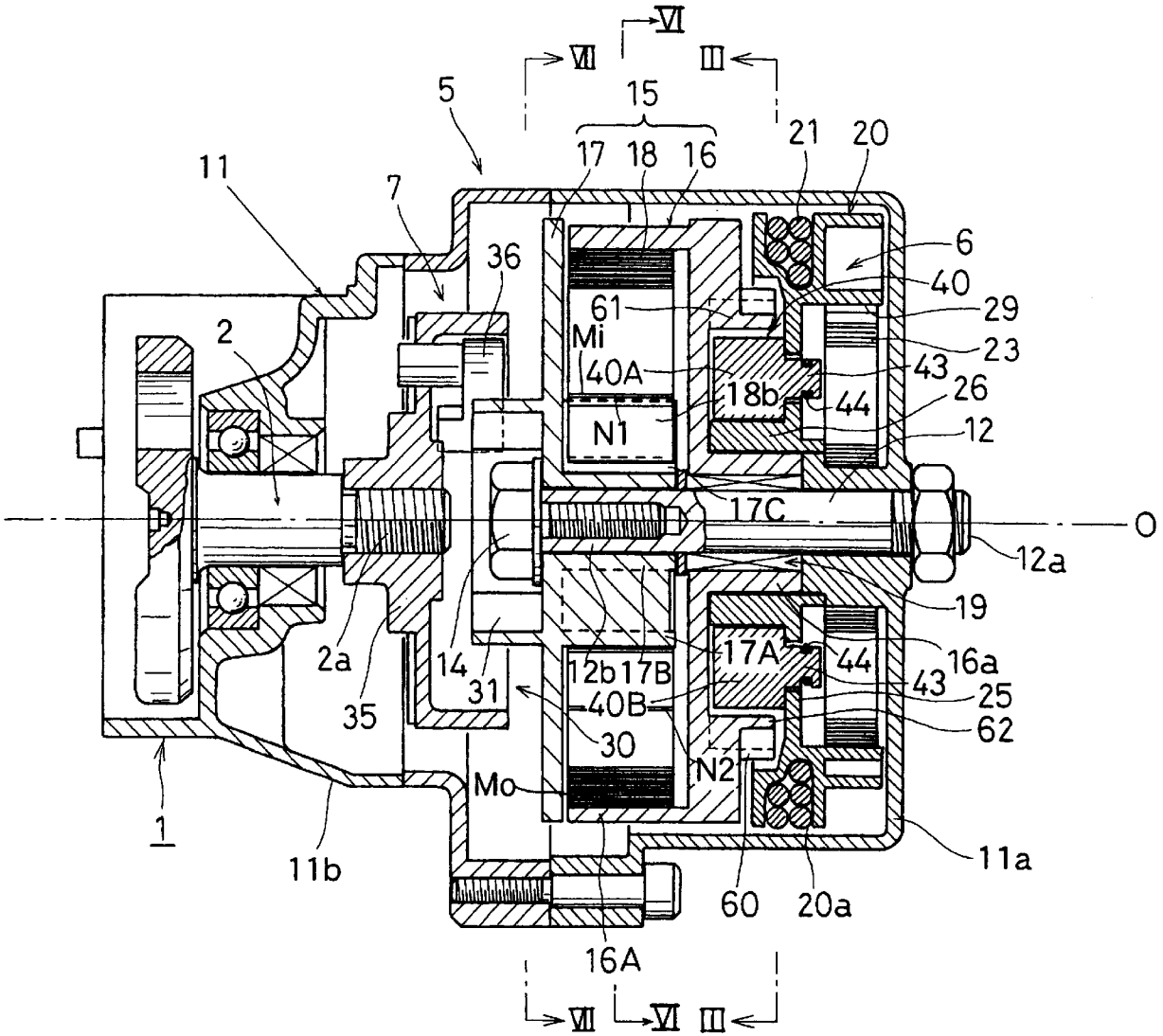
FIG. 1 is a cross-sectional view of a starter representing one embodiment of the recoil starter according to the present invention.

FIG. 1 is a cross-sectional view of a starter representing one embodiment of the recoil starter according to the present invention. Referring to these FIG. 1, the recoil starter 5 shown therein is designed so as to be disposed close to one end 2*a* of a crankshaft 2 of an internal combustion engine 1 such as a small air-cooled internal combustion engine of 23 mL to 50 mL in displacement. This recoil starter 5 comprises a case 11 which is adapted to be mounted on one sidewall of the internal combustion engine 1. This case 11 is composed of a two-piece structure forming a cylindrical structure. Inside an outer case member 11*a* of the case 11, which is located away from the internal combustion engine 1, there is disposed a driving member 6 which is adapted to be revolved through pulling manipulation of a recoil rope 21 (recoil handle 22). On the other hand, inside an inner case member 11*b* of the case 11, which is located close to the internal combustion engine 1, there is disposed a driven member 7 which is adapted to be revolved independent from the driving member 6.

More specifically, an anchoring shaft 12 is disposed extending coaxially from the center of the outer case member 11*a*. A rope reel 20 having the recoil rope 21 wound there a round is rotatably fitted on the proximal end portion of the anchoring shaft 12, and a buffering/power-accumulating spiral spring mechanism 15 comprising a spiral spring case 16 acting as an interlocking rotational body, an actuating pulley 17 and a buffering/power-accumulating spiral spring 18 is rotatably fitted on the protruded end portion of the anchoring shaft 12, i.e. at an intermediate portion between the rope pulley 20 and an interlocking pulley 35 constituting a driven member 7 so as to permit the buffering/power-accumulating spiral spring means 15 to be rotated independent from the rope pulley 20. At the same time, a stopper screw 14 is screw-engaged with the protruded end portion of the anchoring shaft 12.

In this case, the central axial line of the anchoring shaft 12, the rotational axial line of the rope pulley 20, the rotational axial line of the buffering/power-accumulating spiral spring means 15, and the rotational axial line of the interlocking pulley 35 constituting the driven member 7 are all disposed so as to lie on the rotational axial line O of the crankshaft 2, so that the rotation of the rope pulley 20 is enabled to be transmitted via the buffering/power-accumulating spiral spring means 15 and the interlocking pulley 35 to the crankshaft 2 of the internal combustion engine 1.

Figure 4:
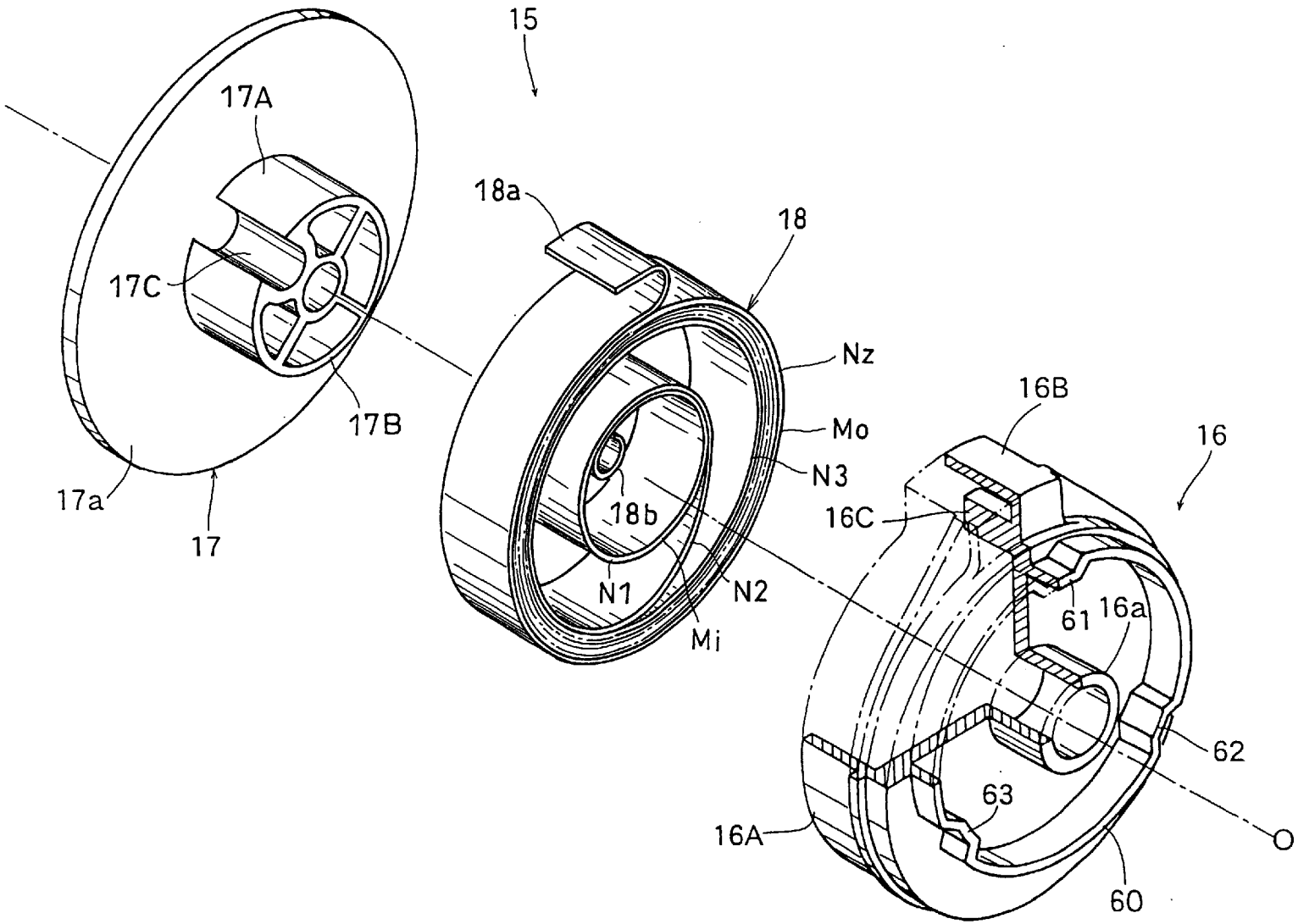
FIG. 4 is a partially cut out exploded perspective view showing a spiral spring mechanism which is designed to be installed in the recoil starter shown in FIG. 1.
Figure 5:
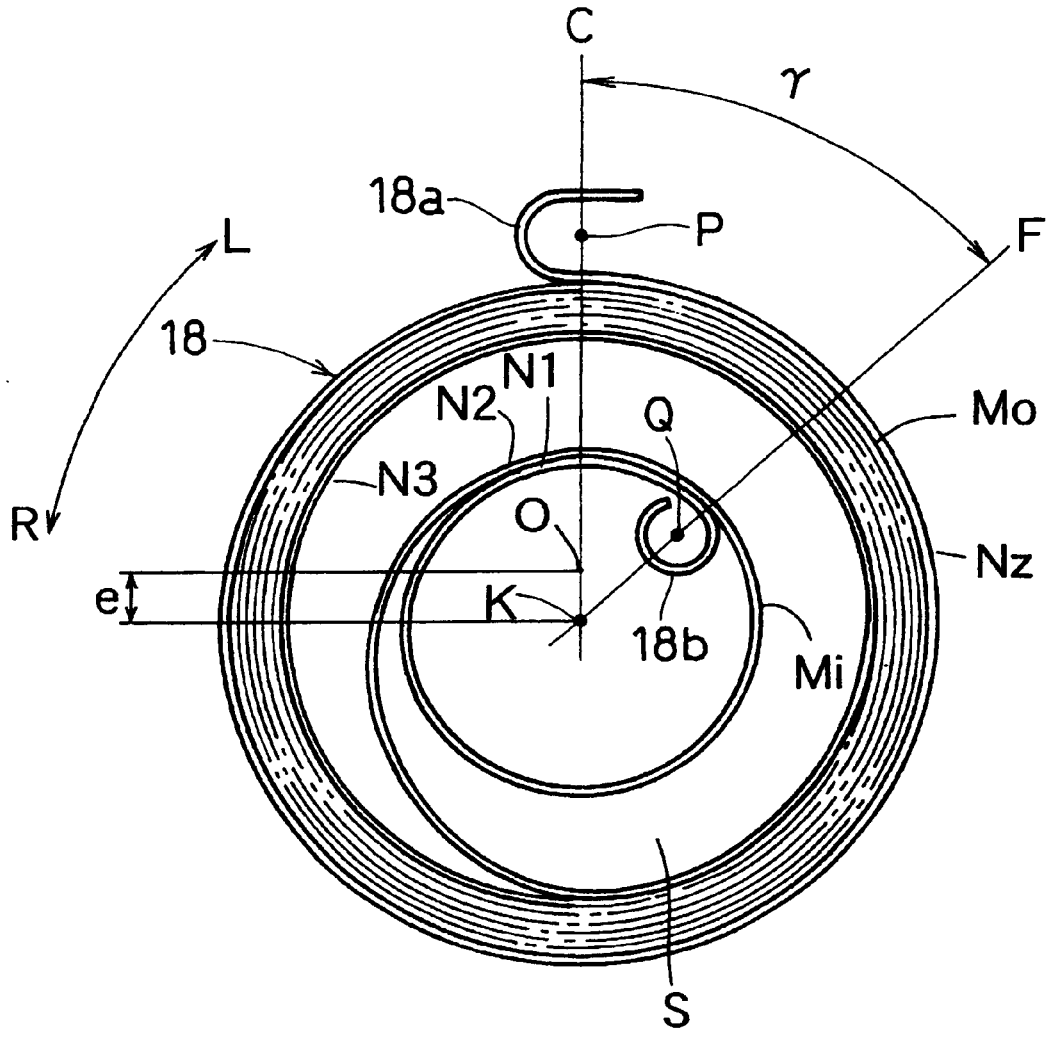
FIG. 5 is an enlarged view showing a freely released state of the spiral spring before the spiral spring is installed in the recoil starter shown in FIG. 1.
Figure 6:
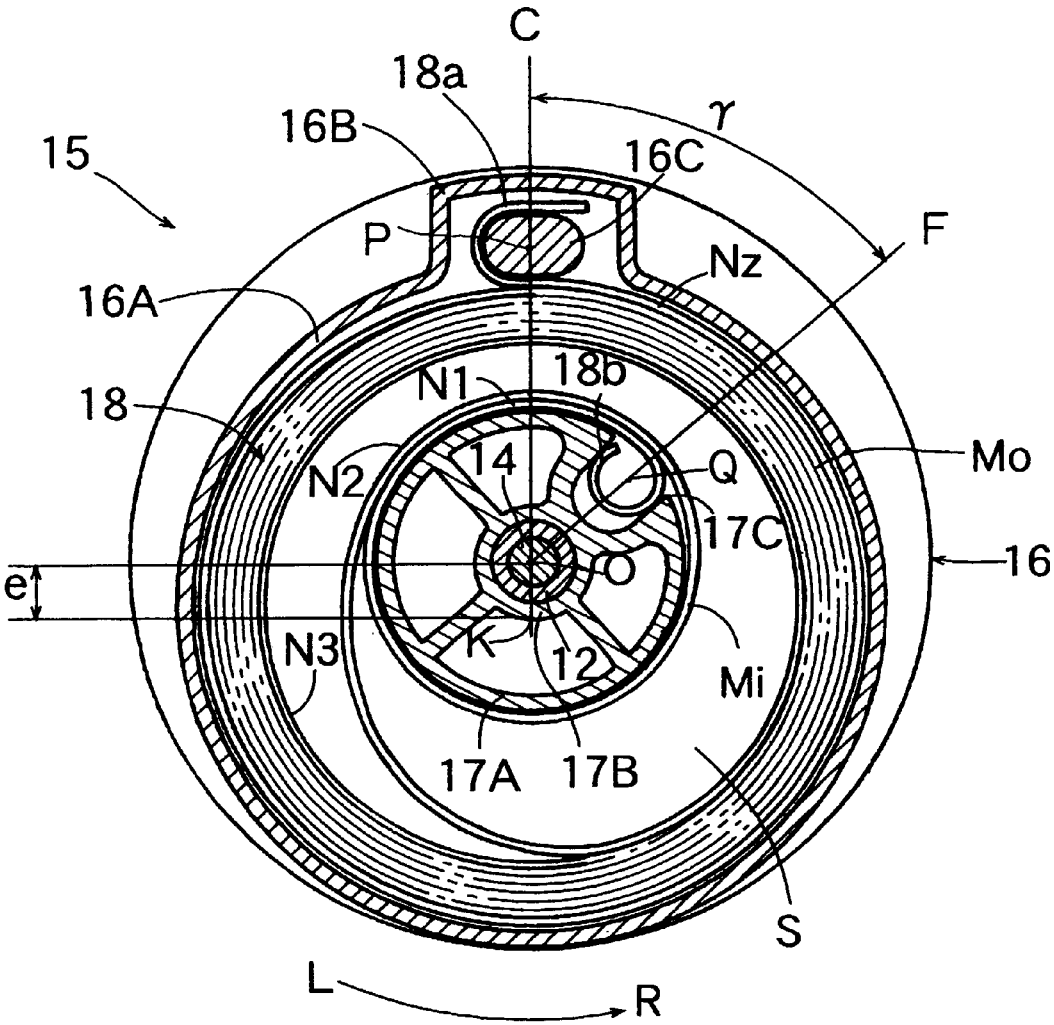
FIG. 6 is a cross-sectional view taken along the line VI—VI of FIG. 1.

As clearly seen from FIGS. 4 to 6 in addition to FIG. 1, the buffering/power-accumulating spiral spring means 15 comprises the spiral spring case 16 which is disposed close to the driving member 6, the actuating pulley 17 which is disposed close to the driven member 7, and the spiral spring 18 which is interposed between the spiral spring case 16 and the actuating pulley 17, wherein the buffering/power-accumulating spiral spring 18 is interposed between the spiral spring case 16 disposed on the input side and the actuating pulley 17 on the output side. Further, the spiral spring case 16 and the actuating pulley 17 are coaxially arranged so as to lie on the same axis, thereby enabling them to be rotated relative to each other. As described hereinafter, the outer end portion of the spiral spring 18 is secured to the spiral spring case 16, while the inner end portion thereof is secured to the actuating pulley 17, so that when either one of the spiral spring case 16 and the actuating pulley 17 is rotated relative to the other, the torque thereof is permitted to be given to the other.

More specifically, as clearly shown in FIG. 5 where the spiral spring 18 is shown as it is taken out of the spiral spring mechanism 15 (a freely released state thereof before being assembled), the spiral spring 18 is provided, at the outer end portion thereof, with a U-shaped external hook end 18*a*, and at the inner end portion thereof, with an annular internal hook end 18*b*. In a freely released state of the spiral spring 18, an outer circumferential wound portion Mo where a predetermined number of turns of the spiral spring 18 are closely contacted is formed, and an inner circumferential wound portion Mi which is constituted by at least one turn is formed, wherein a clearance (S) is provided between the outer circumferential wound portion Mo and the inner circumferential wound portion Mi.

More specifically, the outer circumferential wound portion Mo is constituted by a third turn N3 of the spiral spring 18 and the following turns (including the outermost turn Nz) successive to the third turn N3, while the inner circumferential wound portion Mi is constituted by a first turn N1 of the spiral spring 18 and at least a portion of the second turn N2 which is closely contacted with the first turn N1. Further, in a freely released state of the spiral spring 18 as shown in FIG. 5, the annular internal hook end 18*b* is positioned so as to be displaced from the location of the external hook end 18*a* by a predetermined angle $\gamma$ (40 to 50 degrees in this embodiment) toward the direction L which is opposite to the driving direction R to be explained hereinafter. By the way, this angle $\gamma$ is an angle formed between a straight line C passing through the center K of the spiral spring 18 and through the center P of the external hook end 18*a* (or of an external end-fastening stub 16C which is formed in the spiral spring case 16), and a straight line F passing through the center K of the spiral spring 18 and through the center Q of the internal hook end 18*b* (or of an internal end-fastening portion 17C which is formed in the actuating pulley 17 as explained hereinafter).

The spiral spring 18 is formed of a stainless steel sheet having a thickness of 0.5 to 0.7 mm, and the effective inner diameter Di of the first turn N1 is set to about 30 mm. An annealing treatment is performed on the inner circumferential wound portion Mi of the spiral spring 18 (at least the first turn N1 and the second turn N2 thereof).

The spiral spring case 16 is provided with a cylindrical boss portion 16*a* at the center of a sidewall thereof facing the driving member 6. A one-way clutch 19 is interposed between the inner peripheral wall of the cylindrical boss portion 16*a* and the anchoring shaft 12, so that the spiral spring case 16 is rotatably supported by the anchoring shaft 12 in such a manner that it can be rotated unidirectionally (in the rewinding direction of the spiral spring 18) about the anchoring shaft 12. The spiral spring case 16 is further provided, on one of the sidewalls thereof facing the driven member 7, with a projected short cylindrical portion 16A for housing the spiral spring 18. This spiral spring-housing cylindrical portion 16A is provided with a disengagement-preventing protruded portion 16B which is outwardly projected in the radial direction for housing therein the external hook end 18*a* of the spiral spring 18. Inside this protruded portion 16B, there is disposed the external end-fastening stub 16C having an oval cross-section, which is protruded toward the driven member 7 so as to be fixedly fitted with the external hook end 18*a*.

The actuating pulley 17 is provided, at the center of the sidewall thereof facing the driving member 6, with a projected cylindrical boss portion 17B which is rotatably fitted on the anchoring shaft 12. This cylindrical boss portion 17B is provided on the outer circumferential wall thereof with a core portion 17A around which the spiral spring 18 is designed to be wound. This core portion 17A is provided with the internal end-fastening portion 17C forming a longitudinal groove having a U-shaped cross-section so as to enable the ring-shaped internal hook end 18*b* of the spiral spring 18 to be fitted and engaged therewith.

The outer diameter of the core portion 17A is made almost identical with the effective inner diameter Di of the first turn N1 of the spiral spring 18. The effective outer diameter Do of the spiral spring 18 under the freely released condition thereof is made almost identical with the effective inner diameter of the spiral spring-housing cylindrical portion 16A of the spiral spring case 16.

Additionally, according to this embodiment, the rotational axial line O of the spiral spring mechanism 15 is displaced from the proper center K of the spiral spring 18 shown in FIG. 5 by a predetermined distance "e" toward the external hook end 18*a*. In other words, under the assembled condition of the spiral spring mechanism 15, where the spiral spring 18 is housed inside the spiral spring-housing cylindrical portion 16A of the spiral spring case 16, where the core portion 17A of the actuating pulley 17 is fitted in the inner circumferential wound portion Mi of the spiral spring 18, and where the external hook end 18*a* and internal hook end 18*b* of the spiral spring 18 are anchored to the external end-fastening stub 16C and the internal end-fastening portion 17C, respectively, the center of the inner circumferential wound portion Mi of the spiral spring 18 is decentered from the proper center K of the spiral spring 18 by the predetermined distance "e" toward the external hook end 18*a*. As a result, the range of contact between the first turn N1 and the second turn N2 of the spiral spring 18 is increased, thereby improving the retention force of the spiral spring 18 to wind around the core portion 17A of the actuating pulley 17.

On the other hand, between the outer case member 11*a* and the spiral spring case 16, there is disposed a rope pulley 20 having a stepped disc-like configuration. This rope pulley 20 is provided on the outer peripheral wall thereof with annular groove 20*a* so as to enable the recoil rope 21 to be wound around it. This rope pulley 20 is further provided at the center of inner periphery thereof with a cylindrical boss 26 which is designed to be rotatably fitted on the cylindrical boss portion 16*a* of the spiral spring case 16. This cylindrical boss 26 is provided with a pair of claw-retaining portions 27A and 27B to be engaged with a recoil ratchet mechanism 40, and a pair of spring retaining portions 28A and 28B each corresponding to the claw-retaining portions 27A and 27B, respectively. These spring retaining portions 28A and 28B as well as claw-retaining portions 27A and 27B are respectively spaced apart from each other by an angle of 180 degrees and radially extended outward, thereby forming a cross-shaped or 卍-shaped configuration constituted by a total of these four portions.

Figure 7:
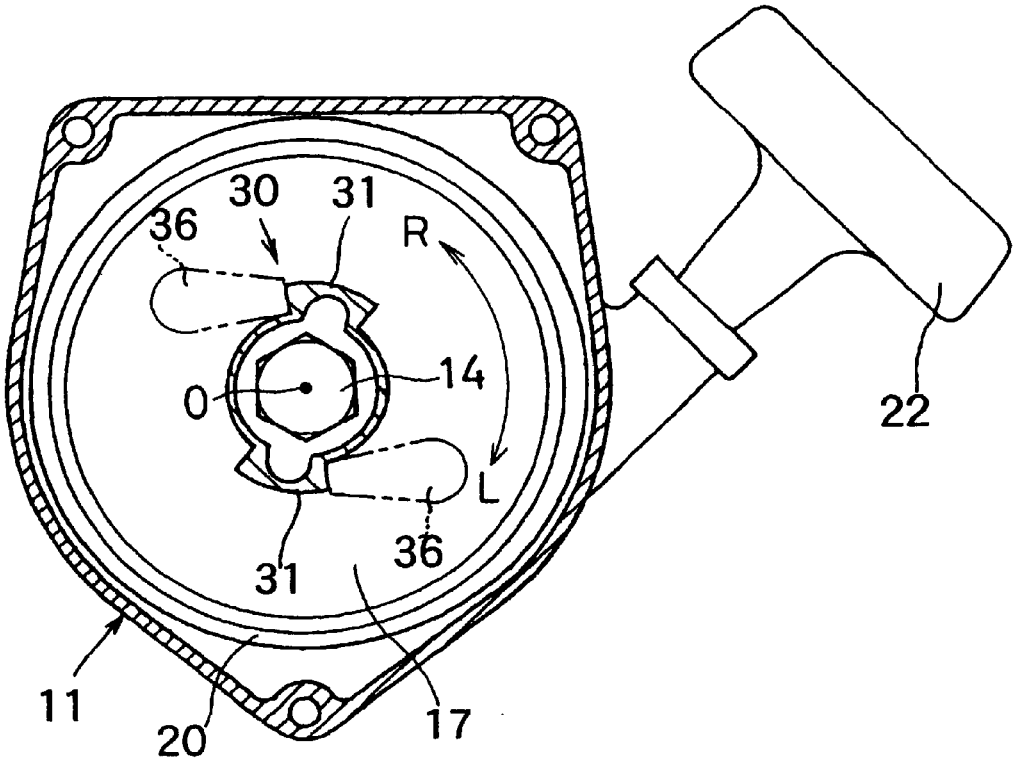
FIG. 7 is a sectional view taken along the line VII—VII of FIG. 1.

In the same manner as in the case of the conventional recoil type starter, although details are not shown in the drawings, one end of the rope 21 is fastened to a bottom portion of the groove 20*a*, while the other end of the rope 21 which is extended out of the outer case member 11*a* is fastened to a recoil handle 22 (see FIG. 7).

Further, between the rope reel 20 and the outer case member 11*a*, there is interposed a recoil spiral spring 23, the outer end of which being fastened to the rope reel 20, and the inner end of which being fastened to a central portion of the outer case member 11*a*. The rope reel 20 is designed to be rotated by pulling the rope 21, and then allowed to return to the original portion on account of the restoring force accumulated in the recoil spiral spring 23, thereby enabling the rope 21 to be automatically wound up.

The recoil ratchet mechanism 40 is interposed between the rope reel 20 and the spiral spring case 16.

Figure 2:
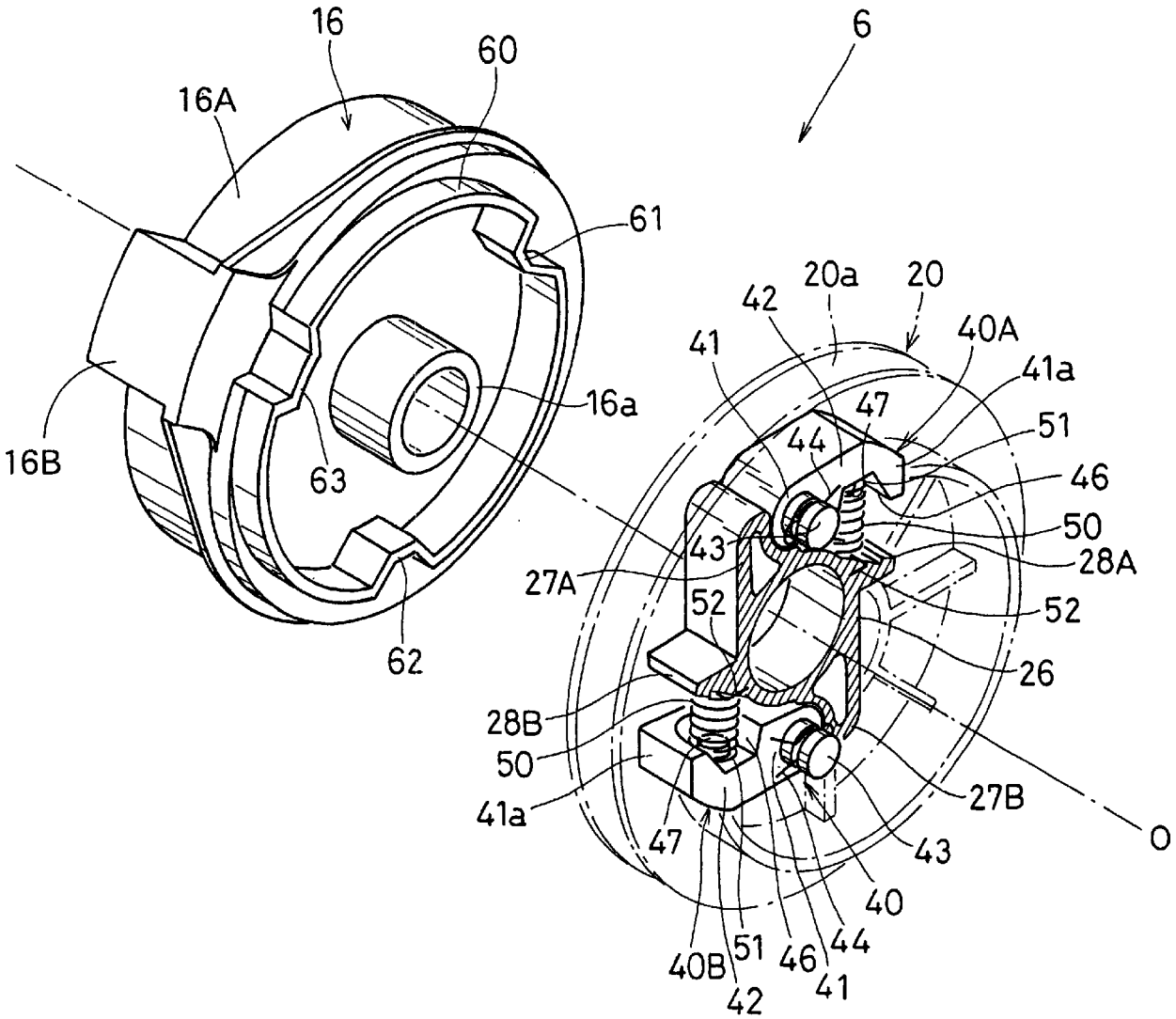
FIG. 2 is a partially cut out perspective view showing a recoil ratchet mechanism which is interposed between the rope reel and the spiral spring case, which are designed to be installed in the recoil starter shown in FIG. 1.
Figure 3:
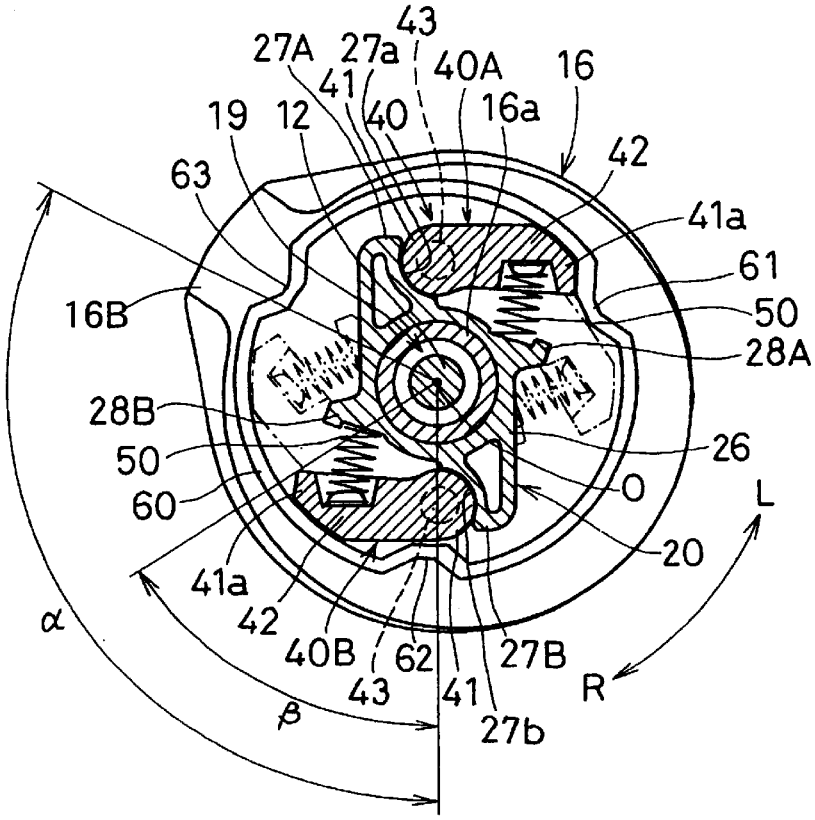
FIGS. 3A and 3B show respectively an enlarged sectional view taken along the line III—III of FIG. 1.
Figure 3:
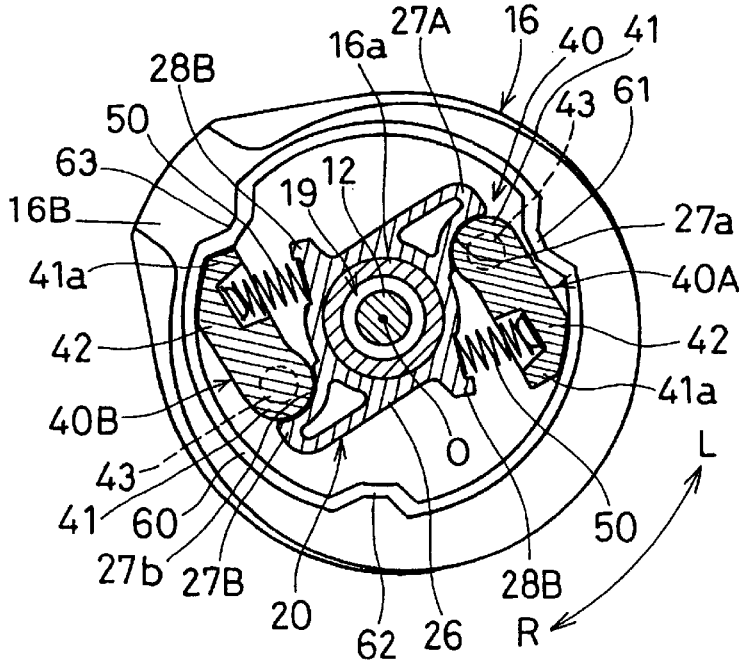

As clearly seen from FIGS. 2 and 3, the recoil ratchet mechanism 40 comprises, on one of the sidewalls of the rope pulley 20 facing the spiral spring case 16, a couple of ratchet claws 40A and 40B which are spaced apart from each other by an angle of 180 degrees and enabled respectively to swing, a couple of compressing coil springs 50 functioning respectively as an urging member for urging the couple of ratchet claws 40A and 40B to outwardly turn in the radial direction, and a short cylindrical claw-receiving portion 60 which is projected from one of the sidewalls of the spiral spring case 16 facing the rope pulley 20. The claw-receiving portion 60 is provided with three trapezoidal engaging portions 61, 62 and 63 which are spaced apart from each other by an angle of a (an angle of 120 degrees in this embodiment) and are depressed inwardly.

The ratchet claws 40A and 40B are respectively constituted by a proximal end portion 41 having a semi-cylindrical surface and provided with an oscillating axis 43 which is rotatably fitted in a bearing hole 25*a* formed in the plate portion 25 of the rope pulley 20 and located close to each of a couple of claw-retaining portions 27A and 27B, and by an arm portion 42 extended from the proximal end 41 and having an inwardly bent distal end 41*a*. By the way, the semi-cylindrical surface of the proximal end portion 41 is designed to be slidably contacted with the claw-retaining portion 27A or 27B. A locking pin 44 is insertedly attached to the distal end portion of the oscillating axis 43.

Between the arm portions 42 and a pair of the spring retaining portions 28A and 28B of the cylindrical boss portion 26 of the rope pulley 20, there are interposed a pair of the compressing coil springs 50 each functioning as an urging member for always urging the ratchet claws 40A and 40B so as to outwardly turn in the radial direction, thereby enabling the bent distal end portion 41*a* to be pressed against the claw-receiving portion 60 of the spiral spring case 16, whereby the bent distal end portions 41*a* are permitted to be engaged, in a proper posture, with the engaging portions 61, 62 and 63 of the claw-receiving portion 60.

In this case, one end portion 51 of each of the compressing coil springs 50 is inserted into a disengagement-preventing recessed portion 46 which is provided at the distal end of the arm portion 42 of each of the ratchet claws 40A and 40B, and at the same time, the one end portion 51 of each of the compressing coil springs 50 is externally fitted over a disengagement-preventing protruded portion 47 which is projected inside the recessed portion 46. On the other hand, the other end portion 52 of each of the compressing coil springs 50 is bent in the form of hook so as to be introduced into and engaged with a hanging hole formed in the rope reel 20.

The driven member 7 is constituted by the interlocking pulley 35, and a centrifugal ratchet mechanism 30. As clearly seen from the FIG. 7, the centrifugal ratchet mechanism 30 comprises a pair of power transmission engaging protrusions 31 which are projected from one of the sidewalls of the actuating pulley 17 facing the engine 1, and the interlocking pulley 35 which is anchored to the one end 2*a* of the crankshaft 2. A couple of starting claws 36 for instance are swingably supported by the interlocking pulley 35. These starting claws 36 are generally urged to turn inward (toward the rotational axial line O) by means of biased spring (not shown), thereby enabling these starting claws 36 to be engaged with the power transmission engaging protrusions 31. However, when the internal combustion engine 1 is started, these starting claws 36 are caused to outwardly turn radially due to the centrifugal force generated by the rotation of the interlocking pulley 35 that has been driven by the crankshaft 2, the aforementioned engagement is enabled to be automatically disengaged.

In the case of the recoil starter 5 according to this embodiment which is constructed as explained above, when the recoil rope 21 (or the recoil handle 22) is manually pulled, the rope pulley 20 is caused to revolve in clockwise in FIG. 3 (in the direction of R), whereby a couple of the ratchet claws 40A and 40B (which are spaced apart from each other by an angle of 180 degrees) are enabled to rotate integral with the rope pulley 20. When this couple of ratchet claws 40A and 40B are started to rotate, one of the ratchet claws, e.g. the ratchet claw 40A is permitted to contact with one of three engaging portions 61, 62 and 63 (spaced apart by an angle of 120 degrees [$=\alpha$]) that have been provided in the spiral spring case 16, e.g. with the engaging portion 61 as shown in FIG. 3(A). On this occasion, the other ratchet claw 40B is positioned at a place which is spaced away by a predetermined angle $\beta$ ($180°-120°=60°$) from the other two engaging portions 62 and 63 out of three engaging portions 61, 62 and 63.

In this case, since the aforementioned other ratchet claw 40B is positioned away from the engaging portions 61, 62 and 63, the ratchet claw 40B is kept in a proper state where the bent distal end portion 41*a* is pressed onto the claw-receiving portion 60 provided in the spiral spring case 16 due to the urging force of the compressing coil spring 50 so as to enable the bent distal end portion 41*a* to be properly engaged with the engaging portions 61, 62 and 63.

In this case, according to the conventional structure, when one of the ratchet claws, e.g. the ratchet claw 40A rides over the engaging portion 61 without properly engaging with the engaging portion 61 (as shown by a phantom line in FIG. 3(A)), the ratchet claws are permitted to ride over the engaging portion one after another, thereby generating a lot of loss in the pulling operation of the rope. Whereas, according to this embodiment, even if one of the ratchet claws, e.g. the ratchet claw 40A rides over the engaging portion 61, the other ratchet claw 40B is enabled, under a proper state, to be immediately contacted with the engaging portion 62 as soon as the rope reel 20 is slightly rotated as shown in FIG. 3(B), thereby enabling the rotation (or torque) of the rope reel 20 to be reliably transmitted to the spiral spring case 16.

Therefore, it is possible, with the recoil starter 5 of this embodiment, to suppress the generation of loss in the pulling operation of the recoil rope, to prevent the pulling operation of recoil rope from becoming vacant, and to obtain a smooth pulling feeling of the recoil rope.

Further, since the compressing coil spring 50 is employed as an urging member with one end portion 52 thereof being formed into a hook-like configuration so as to enable it to be secured to the rope reel 20, the urging member can be prevented from being easily disengaged from the rope reel 20, thereby improving the reliability of the recoil starter.

When the operation of pulling the rope 21 is performed in this manner, the rotation of the driving member 6 can be transmitted, via the spiral spring mechanism 15 and the interlocking pulley 35, to the crankshaft 2 of the internal combustion engine 1.

In this case, during the first-half driving process (until the piston of the internal combustion engine 1 reaches to the top dead center) in the operation of pulling the recoil rope 21 (recoiling operation), it is possible to derive a buffering effect from the spiral spring mechanism 15, and at the same time, to accumulate the drawing force of the recoiling rope 21 in a spiral spring mechanism 15, and during the latter-half driving process, the driving force thus accumulated in the spiral spring mechanism during the first-half driving process is permitted to be combined with the pulling force to be actually effected by the recoiling rope 21 in the latter-half driving process to thereby generate a resultant force, the energy of which being sufficiently large enough to overcome the load of the compression of the internal combustion engine 1, thus providing a sufficient energy for starting the internal combustion engine 1. As a result, it is possible to minimize a fluctuation in pulling force of rope so as to make smooth the rope-pulling operation, thus enabling even a person having a weak physical strength to easily start the engine (for more details, see Japanese Patent Application No. H11-238642).

Further, in the case of the recoil starter 5 according to this embodiment, since it is constructed such that part of the second turn N2 is closely contacted with the first turn N1 at the inner circumferentially wound portion Mi of the spiral spring 18, that the internal hook end 18*b* is displaced as mentioned above, and that the specifications of the spiral spring 18 and the spiral spring mechanism 15 are designed as explained above, the interlocking between the spiral spring mechanism 15 and the internal combustion engine 1 can be disengaged from each other after the start-up of the internal combustion engine due to the free releasing effects to be obtained from the centrifugal ratchet mechanism 30 mounted on the driven member 7, thereby rendering the spiral spring mechanism 15 into a free state. In this case, even if the spiral spring 18 is excessively kicked back in the unwinding direction (releasing direction) thereof due to the inertia on this occasion even after the spiral spring 18 has been completely unwound, this kick-back stress to be repeated by the effects of rewinding-unwinding on this occasion can be received by the entire body of the inner circumferentially wound portion Mi, thereby making it possible to suppress the generation of a concentration of the stress in the vicinity of the internal hook end 18*b* of the spiral spring 18.

As a result, the generation of settling or breakage of the spiral spring 18 can be prohibited, thereby making it possible to improve the durability of the spiral spring 18, and at the same time, the internal hook end 18*b* of the spiral spring 18 can be prevented from being easily disengaged from the core portion 17C provided at the actuating pulley 17 of the spiral spring mechanism 15, thereby further improving the reliability of the recoil starter.

While one embodiment of the present invention has been explained in detail, it will be understood that the construction of the device can be varied without departing from the spirit and scope of the invention.

As clearly seen from the above explanation, it is possible, according to the present invention, to provide a recoil starter having a spiral spring mechanism interposed, as a buffering/power-accumulating means, between a driving member comprising a rope reel which is designed to be rotated by the pulling of a recoil rope, and a driven member to which the torque of the driving member is transmitted, the recoil starter being characterized in that it is capable of inhibiting the generation of settling and bending in the spiral spring of the spiral spring mechanism, thereby making it possible not only to improve the durability of the spiral spring, but also to prevent the internal hook end of the spiral spring from being easily disengaged from the core portion of the actuating pulley of spiral spring mechanism. It is also possible, according to the present invention, to provide a spiral spring which is excellent in durability and therefore is suited for use in the recoil starter, etc.

What is claimed is:

1. A recoil starter which comprises:

a driving member (6) having a rope reel (20) around which a recoil rope (21) is wound to thereby enable said rope reel (20) to be rotated by pulling said recoil rope (21);

a driven member (7) to which the torque of said driving member (6) is transmitted; and a spiral spring mechanism (15) interdisposed, as a buffering/power-accumulating means, between said driving member (6) and said driven member (7);

wherein said buffering/power-accumulating means (15) is enabled, during the driving process by said driving member (6), to accumulate the power supplied through the driving process while alleviating any impact to said driven member (7), the accumulated power being subsequently employed to drive said driven member (7), and wherein said spiral spring mechanism (15) is rendered free after the start-up of an internal combustion engine (1);

said recoil starter being characterized in that said spiral spring mechanism (15) comprises a spiral spring case (16) placed close to said driving member (6), an actuating pulley (17) placed close to said driven member (7), a spiral spring (18) interposed between said spiral spring case (16) and said actuating pulley (17), and means (19) for rotating said spiral spring case only unidirectionally, wherein an outer end portion **(18*a*) of said spiral spring (18) and an inner end portion (18*b*) of said spiral spring (18) are fastened to said spiral spring case (16) and said actuating pulley (17), respectively, wherein said spiral spring (18) comprises an outer circumferential wound portion (Mo) where a predetermined number of turns of the outer circumferentially wound portion (Mo) of the spiral spring (18) are closely contacted with each other under a freely released condition of the spiral spring (18), and an inner circumferential would portion (Mi) which is constituted by at least one turn of said inner circumferentially wound portion (Mi) of said spiral spring (18)**, wherein a clearance (S) is provided between said outer circumferential wound portion (Mo) and said inner circumferential would portion (Mi).

2. The recoil starter according to claim 1, wherein said means for rotating said spiral spring case (16) only unidirectionally is preferably constituted by a one-way clutch (19).

3. The recoil starter according to claim 1, wherein said outer circumferential wound portion (Mo) is constituted by a third turn (N3) and the following turns successive to said third turn (N3), and said inner circumferential wound portion (Mi) is constituted by a first turn (N1) and at least a portion of the second turn (N2) which is closely contacted with said first turn (N1).

4. The recoil starter according to claim 1, wherein said actuating pulley (17) is provided with a core portion (17A) around which said spiral spring (18) is wound; said spiral spring (18) is provided, at an inner end portion thereof, with a C-shaped or ring-shaped internal hook end **(18*b*); and said core portion is provided with an inner end-holding portion (17C) into which said internal hook end (18*b*)** is adapted to be inserted and held therein.

5. The recoil starter according to claim 1, wherein said spiral spring (18) is provided, at an outer end portion thereof, with an external hook end **(18*a*); and said spiral spring case (16) is provided, at an outer circumferential wall thereof with an outer end-holding portion (16C) with which said external hook end (18*a*)** is adapted to be engaged.

6. The recoil starter according to claim 1, wherein said inner end portion **(18*b*) of said spiral spring (18) is positioned, under a freely released condition of said spiral spring (18), at a position which is displaced from the location of said outer end portion (18*a*) of said spiral spring (18)** by a predetermined angle ($\gamma$) toward one direction (L) which is opposite to a driving direction (R).

7. The recoil starter according to claim 1, wherein the rotational axial line (O) of said spiral spring mechanism (15) is preferably displaced from the proper center (K) of said spiral spring (18) by a predetermined distance (e) toward said outer end portion **(18*a*) of said spiral spring (18)**.

8. The recoil starter according to claim 4, wherein the outer diameter of said core portion (17A) of actuating pulley (17) is made almost identical with the effective inner diameter (Di) of the first turn (N1) of said spiral spring (18), and the effective outer diameter (Do) of said spiral spring (18) under the freely released condition thereof is made almost identical with the effective inner diameter of said spiral spring case (16).

9. The recoil starter according to claim 4, wherein said effective inner diameter (Di) of said first turn (N1) of said spiral spring (18) and the effective outer diameter of said core portion (17A) are set to 25 mm or more.

10. The recoil starter according to claim 1, wherein said spiral spring (18) is formed of a stainless steel sheet having a thickness of 0.5 to 0.7 mm.

11. The recoil starter according to claim 1, wherein the inner circumferential wound portion of said spiral spring (18) has been subjected to an annealing treatment.

12. The recoil starter according to claim 1, wherein said driving member (6) is provided with a recoiling urging means (23) for reversely revolving said rope reel (20) so as to rewind said recoil rope (21), and also with a recoil ratchet mechanism (40) for transmitting the torque of said rope reel (20) to said spiral spring case (16).

13. The recoil starter according to claim 1, wherein said driven member (7) is provided with an interlocking pulley (35) having a power transmission mechanism (30) through which said driven member (7) is enabled to interlockingly coupled with said driving member (6).

14. The recoil starter according to claim 13, wherein said power transmission mechanism is constituted by a centrifugal ratchet mechanism (30).

* * * * *